US011939734B1

(12) United States Patent
Pauwels

(10) Patent No.: US 11,939,734 B1
(45) Date of Patent: Mar. 26, 2024

(54) HALF BARREL TRAFFIC BARRICADE

(71) Applicant: Creative Product Marketing Strategies LLC, Fort Wayne, IN (US)

(72) Inventor: Dennis L. Pauwels, Fort Wayne, IN (US)

(73) Assignee: Creative Product Marketing Strategies LLC, Fort Wayne, IN (US)

( * ) Notice: Subject to any disclaimer, the term of this patent is extended or adjusted under 35 U.S.C. 154(b) by 0 days.

(21) Appl. No.: 18/234,122

(22) Filed: Aug. 15, 2023

(51) Int. Cl.
*E01F 9/688* (2016.01)
*E01F 9/654* (2016.01)
*E01F 9/692* (2016.01)

(52) U.S. Cl.
CPC ..... *E01F 9/654* (2016.02); *E01F 9/692* (2016.02)

(58) Field of Classification Search
CPC ..... E01F 9/604; E01F 9/654; E01F 9/688
USPC ..... 116/63 C, 63 P
See application file for complete search history.

(56) References Cited

U.S. PATENT DOCUMENTS

D243,075 S 1/1977 Kulp et al.
4,083,033 A * 4/1978 Kulp ..... E01F 9/688 116/63 P
4,973,190 A 3/1990 Erwin et al.
5,026,204 A 6/1991 Kulp et al.
5,156,486 A * 10/1992 Davidson ..... E01F 9/612 116/63 P
5,199,813 A 4/1993 Nagler
5,234,280 A 8/1993 Cowan
5,722,788 A 3/1998 Bent et al.
6,019,542 A 2/2000 Bent et al.
7,690,321 B2 * 4/2010 Karow ..... E01F 13/02 116/63 P
8,256,369 B2 * 9/2012 Karow ..... E01F 13/02 116/63 P
8,974,142 B2 * 3/2015 Buehler ..... E01F 15/08 404/6
2004/0079931 A1 * 4/2004 Climente ..... E01F 15/0461 256/13.1

(Continued)

FOREIGN PATENT DOCUMENTS

CA 1075978 A1 4/1980
JP 11-81259 * 3/1999

(Continued)

*Primary Examiner* — Gary S Hartmann
(74) *Attorney, Agent, or Firm* — George Pappas; Barrett McNagny LLP

(57) ABSTRACT

A half barrel traffic barricade for use with an annular traffic barricade base includes a half tube-shaped vertical wall having a top end and a bottom end. A top panel is provided at and closing the vertical wall top end. The annular traffic barricade base is adapted to be received over the vertical wall and engages the bottom end thereof for supporting the traffic barricade in a vertical position. Preferably, the vertical wall further includes a convex front face, a concave rear face, and vertical wall edges. Stacking flanges can be provided extending along the vertical wall edges and a nesting/stacking pocket is defined between the concave rear face and the top panel. The traffic barricade is nestable/stackable with other traffic barricades by inserting the front face thereof into the nesting/stacking pocket of an adjacent traffic barricade with the stacking flanges of adjacent traffic barricades being placed against/abutting one another.

20 Claims, 11 Drawing Sheets

(56) References Cited

U.S. PATENT DOCUMENTS

| | | | | |
|---|---|---|---|---|
| 2008/0181722 | A1* | 7/2008 | McKenney | E01F 15/0453<br>404/6 |
| 2011/0308446 | A1* | 12/2011 | Butler | E01F 9/688<br>116/63 C |
| 2017/0030035 | A1* | 2/2017 | Parnow | E01F 9/654 |

FOREIGN PATENT DOCUMENTS

| | | | | |
|---|---|---|---|---|
| WO | 2012/142421 | A1 | 10/2012 | |
| WO | WO-2012142421 | A1 * | 10/2012 | E01F 9/654 |

* cited by examiner

HALF BARREL TRAFFIC BARRICADE

BACKGROUND OF THE INVENTION

1. Field of the Invention

The present invention relates to traffic delineator devices. More particularly, the present invention is directed to a half barrel traffic barricade which is nestable/stackable for compact storage thereof.

2. Background

Plastic traffic delineator devices are known and are common. They include, for example, lightweight plastic barrels which can be arranged on a roadway for directing and channeling traffic flows. The use of lightweight plastic for these devices, as opposed to wood or metal, has significantly increased driver and pedestrian safety by minimizing damage caused if a vehicle strikes the plastic barrel. However, wind and air movement caused by vehicles driving along the roadway can cause the lightweight plastic barrels to slide or tip over, thereby requiring frequent repositioning.

Accordingly, barrel delineators are typically made in two pieces: an upper barrel and a weighted base. The upper barrel is made of lightweight plastic and is adapted to releasably engage the base which can be made of a heavier, ballast material such as, for example, rubber or recycled automobile tires. There are many types of weighted bases used for plastic barrel barricades. For example, a traditional annular weighted base is shown and described in Nagler, U.S. Pat. No. 5,199,813. In use, the annular weighted base can be received over the barrel and engages a lower lip thereof for preventing the barrel from sliding or being blown or knocked over.

It is often necessary or desirable to transport or store the barrels between projects. In this regard, plastic barrels have traditionally been hollow having an open bottom end and a central cavity. Thus, the barrels can be nested/stacked for transportation or compact storage by inserting the top ends thereof through the open bottom end, and into the central cavity, of an adjacent barrel. Examples of traditional nestable/stackable plastic barrels are shown and described in Bent et al., U.S. Pat. No. 5,722,788; Bent et al., U.S. Pat. No. 6,019,542; Kulp et al., U.S. Pat. No. 5,026,204; Erwin et al., U.S. Pat. No. 4,973,190; Cowan, U.S. Pat. No. 5,234,280.

However, a disadvantage of traditional nestable/stackable plastic barrels is that they generally must be stored upright to prevent the stacked barrels from rolling or moving during transportation, and the nested/stacked plastic barrels commonly become stuck/wedged/jammed together and can require significant effort to separate. Traditional nestable/stackable plastic barrels are also costly to manufacture.

Accordingly, there exists a need for an improved lower cost traffic delineator device which can be nested/stacked together for transportation and/or compact storage thereof and which resists becoming stuck/wedge/jammed with adjacent nested/stacked delineator devices.

SUMMARY OF THE INVENTION

In the present invention, a half barrel traffic barricade for use with an annular traffic barricade base comprises a half tube-shaped vertical wall having a top end and a bottom end. A top panel is provided at and closes the top end of the vertical wall. The annular traffic barricade base is received over the vertical wall and engages the bottom end thereof for supporting the traffic barricade in a vertical position.

Preferably, the vertical wall is stepped and further comprises a convex front face, a concave rear face, and vertical wall edges.

Preferably, the half barrel traffic barricade further comprises stacking flanges provided along the vertical wall edges and a foot extension provided at the bottom end of the vertical wall. The annular traffic barricade base can engage the foot extension for supporting the traffic barricade in its vertical orientation.

Preferably, the convex front face and the concave rear face further comprise one or more reflective portions/surfaces. Yet more preferably, the convex front face and the concave rear face further comprise two or more reflective portions/surfaces which are arranged in an alternating, striped pattern.

Preferably, the half barrel traffic barricade further comprises a handle provided at the top end of the vertical wall, wherein the handle includes one or more mounting bores. Yet more preferably, one or more lights/reflectors are secured to the handle and engage the one or more mounting bores.

In another embodiment, the present invention is directed to a traffic delineator device for directing and channeling traffic comprising an annular traffic barricade base and a half barrel traffic barricade. The half barrel traffic barricade comprises a half tube-shaped vertical wall having a top end and a bottom end and a top panel provided at and closing the top end. The annular traffic barricade base is received over the vertical wall and engages the bottom end thereof for supporting the half barrel traffic barricade in a vertical position.

In yet another embodiment, the present invention is directed to a traffic directing/channeling system comprising a plurality of annular traffic barricade bases and a plurality of half barrel traffic barricades. Each half barrel traffic barricade comprises a half tube-shaped vertical wall having a top end and a bottom end and a top panel provided at and closing the top end. An annular traffic barricade base is received over each vertical wall and engages the bottom end thereof for supporting the half barrel traffic barricades in a vertical position.

Preferably, the vertical walls further comprise convex front faces, concave rear faces, and vertical wall edges, and a nesting/stacking pocket is defined between the concave rear faces and the adjacent top panels. Yet more preferably, the half barrel traffic barricades are nestable/stackable by inserting the front faces thereof into the nesting/stacking pocket of an adjacent half barrel traffic barricade.

Preferably, the half barrel traffic barricades further comprise stacking flanges extending along the vertical wall edges. Yet more preferably, the stacking flanges of adjacent nested/stacked half barrel traffic barricades are placed against/abutting one another for supporting the weight of the nested/stacked half barrel traffic barricades.

BRIEF DESCRIPTION OF THE DRAWINGS

The above-mentioned and other features of this invention and the manner of attaining them will become more apparent, and the invention itself will be better understood by reference to the following description of the embodiments of the invention, taken in conjunction with the accompanying drawings, wherein.

Figure 1:
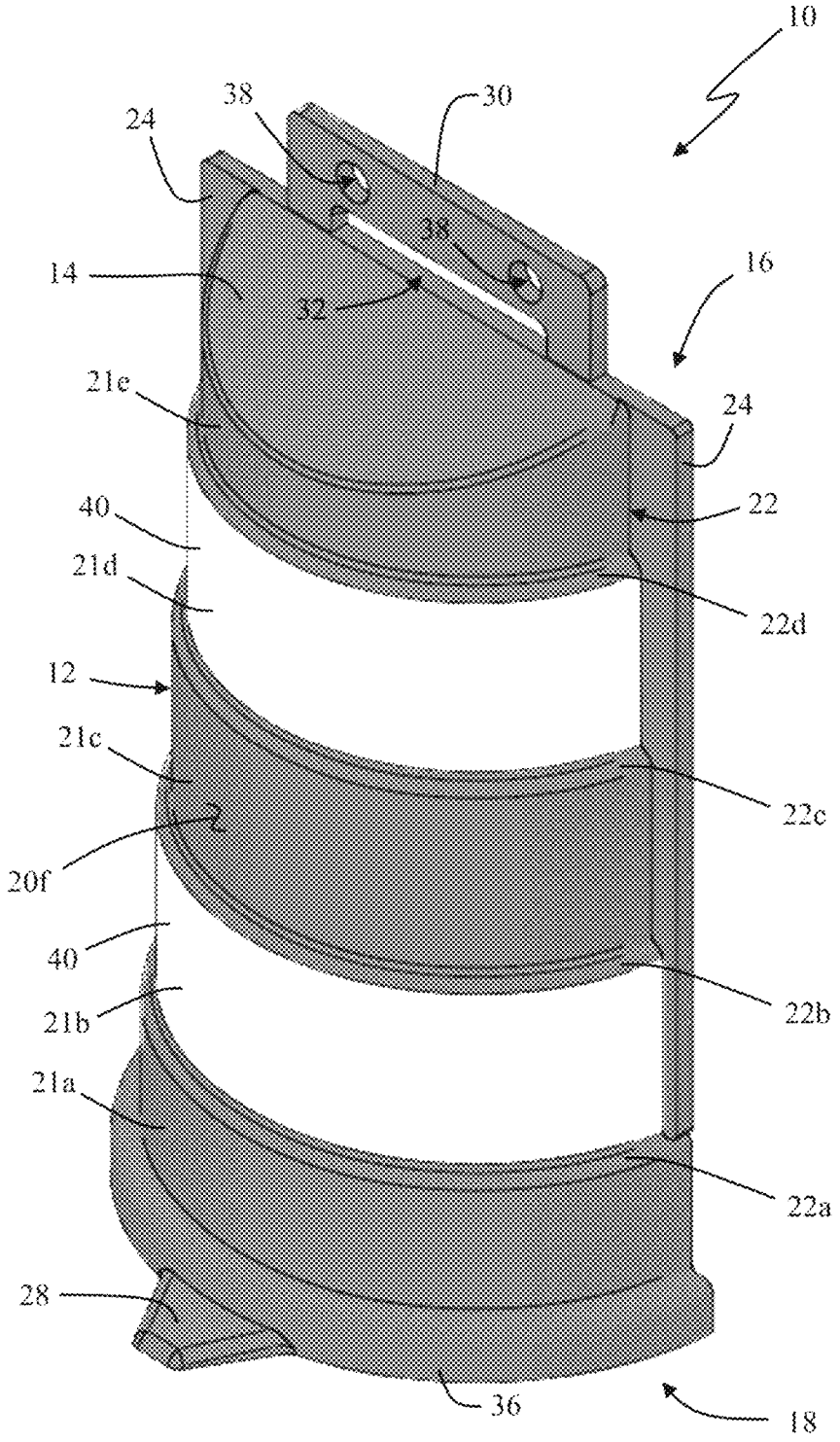
FIG. 1 is a front perspective view of a half barrel traffic barricade constructed in accordance with the principles of the present invention.

Corresponding reference characters indicate corresponding parts throughout several views. Although the exemplification set out herein illustrates certain embodiments of the invention, the embodiments disclosed below are not intended to be exhaustive or to be construed as limiting the scope of the invention to the precise form disclosed.

DETAILED DESCRIPTION OF THE PREFERRED EMBODIMENTS

Figure 2:
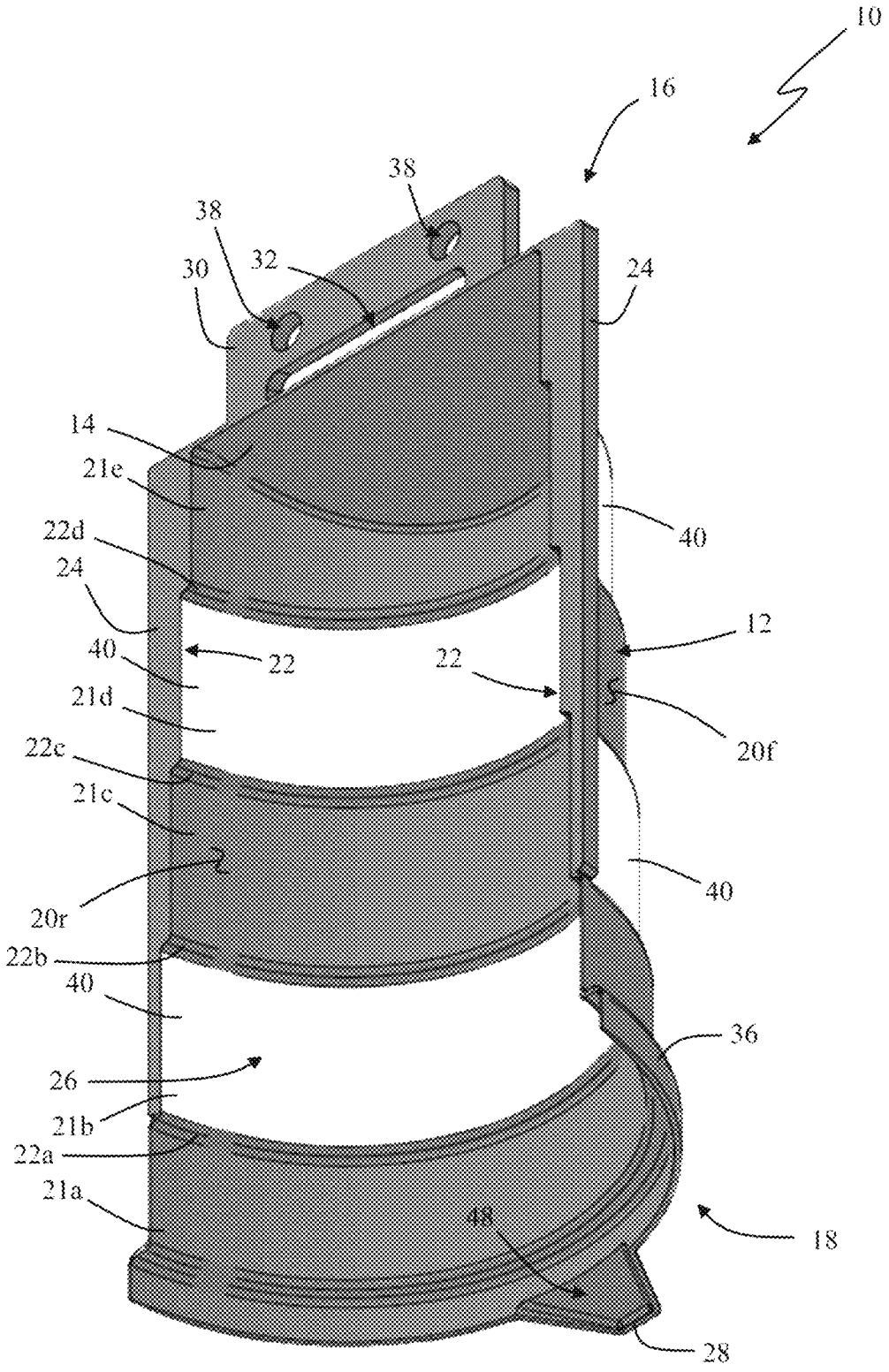
FIG. 2 is a rear perspective view of the traffic barricade.

A half barrel traffic barricade constructed in accordance with the principles of the present invention is shown and designated by the numeral 10. As shown in FIGS. 1 and 2, the traffic barricade 10 comprises a vertical, half tube-shaped wall 12 and a top panel 14. The vertical wall 12 has a top end 16 and a bottom end 18 and comprises a convex front face 20*f*, a concave rear face 20*r*, and vertical wall edges 22. The top panel 14 is secured to the vertical wall 12 closing off the top end 16 thereof. A nesting/stacking pocket 26 is thereby defined between the concave rear face 20*r* and the top panel 14.

Figures 3A, 3B:
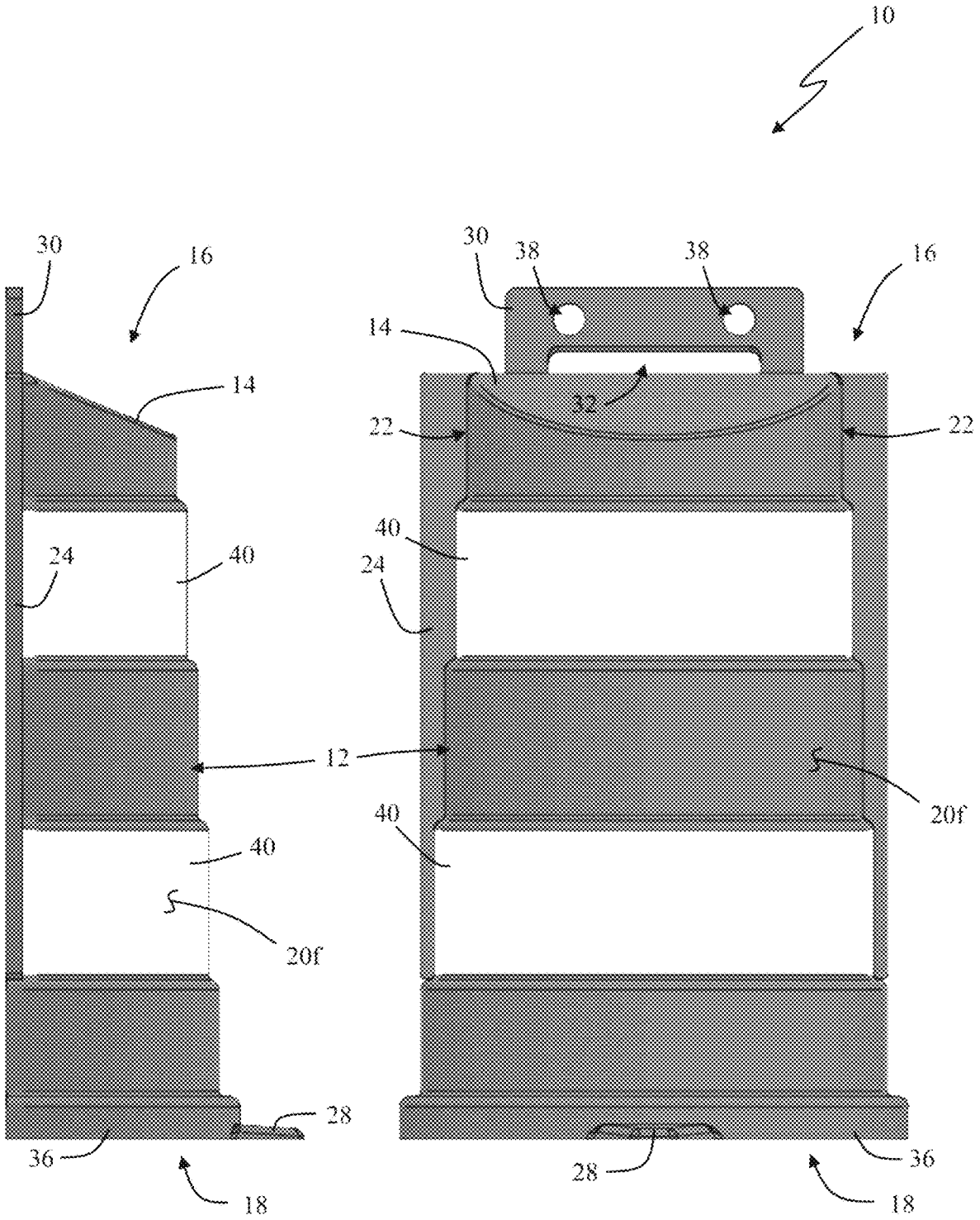
FIG. 3A is a side elevation view of the traffic barricade.
FIG. 3B is a front elevation view of the traffic barricade.
Figure 4:
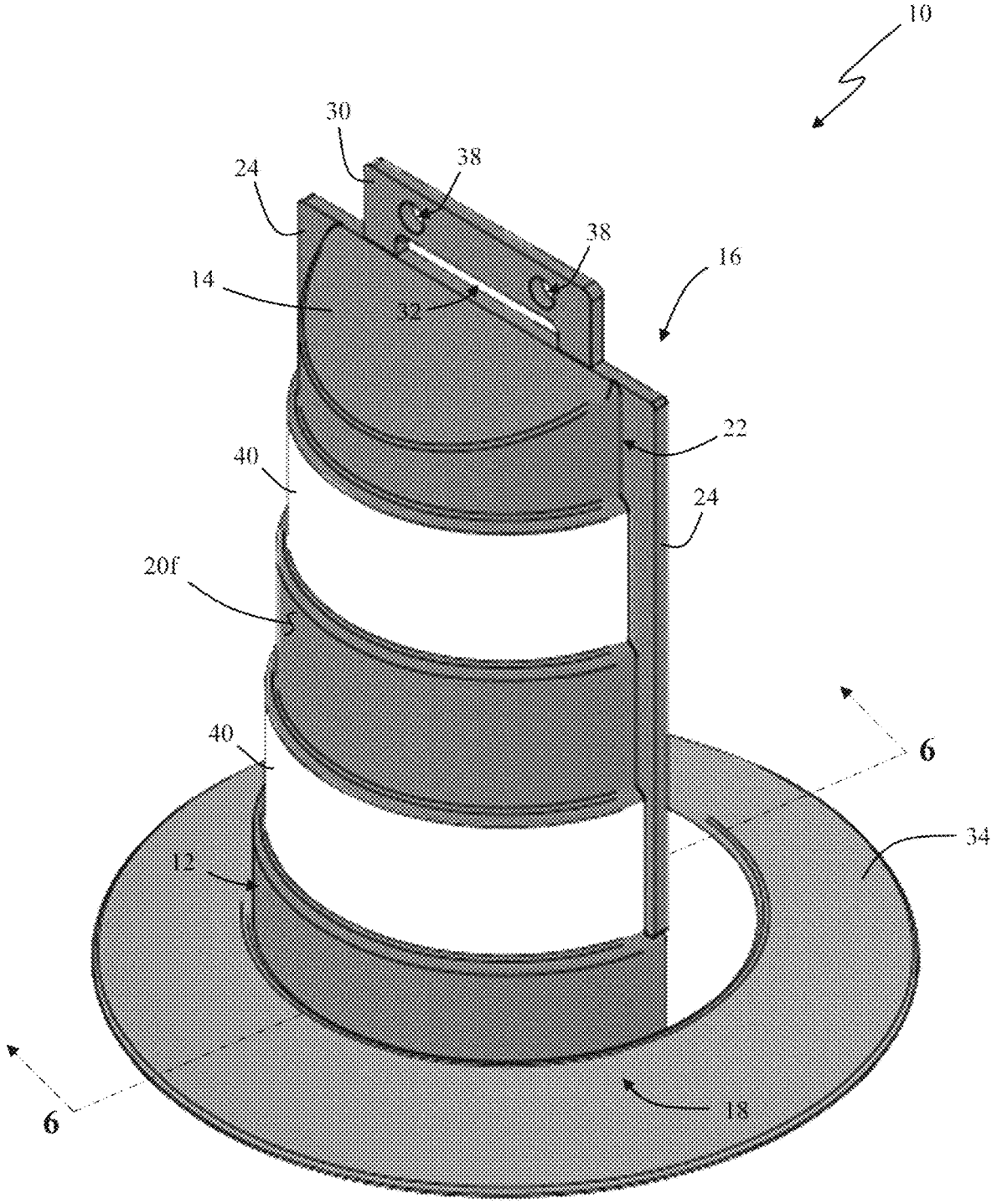
FIG. 4 is a perspective view of the traffic barricade having an annular weighted base received thereover.

As best seen in FIGS. 3A and 3B, the vertical wall 12 is preferably "stepped" and has a vertically converging step shape defined by decreasing diameter half cylinder sections 21*a*, 21*b*, 21*c*, 21*d*, 21*e* and respective connecting steps 22*a*, 22*b*, 22*c*, 22*d* therebetween. The stepped shape of the vertical wall 12 increases the structural rigidity and strength of the traffic barricade 10. Additionally, the top panel 14 secured to the top of half cylinder section 21*e* can be sloped, as best seen in FIG. 4, for stackability purposes and further increasing the structural rigidity and strength of the traffic barricade 10.

Preferably, the traffic barricade 10 can include a foot extension 28 and a handle/mounting bracket 30 defined by and/or having a handle slot 32. The handle/mounting bracket 30 can be provided at the vertical wall 12 top end 16 and the foot extension 28 can be provided at the bottom end 18. The handle/mounting bracket 30 can be used for lifting and moving the traffic barricades 10 as necessary or desired.

Figure 5:
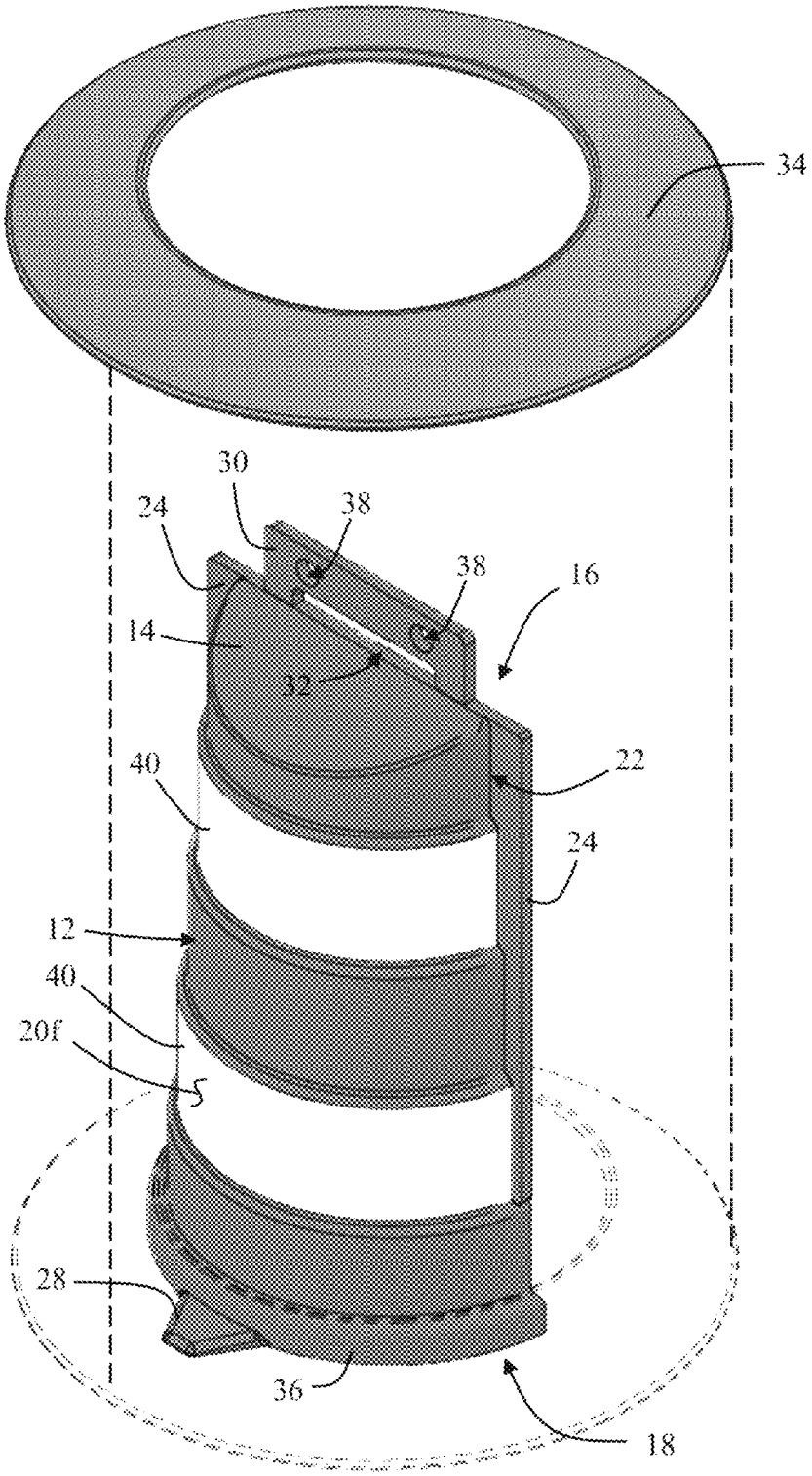
FIG. 5 is an exploded perspective view of the traffic barricade and annular weighted base shown in FIG. 4 prior to placement of the weighted base over and onto the traffic barricade.

In use, the traffic barricades 10 can be placed standing vertically with their bottom ends 18 resting on a road surface (not shown). A plurality of barricades 10 can be arranged as necessary or desired along the road for directing and channeling traffic. Preferably, the traffic barricades 10 are positioned with the front faces 20*f* thereof facing in the direction of on-coming traffic. Additionally, as shown in FIGS. 4 and 5, the traffic barricades 10 are preferably used in conjunction with annular weighted bases 34 which can be received over the traffic barricades 10 and rest on the foot extensions 28 thereof.

The annular weighted bases 34 engage the foot extensions 28 for preventing the traffic barricades 10 from sliding or tipping over from light collisions, wind, and/or air movement caused by passing vehicles. The weighted bases 34 are, preferably, standard, commonly available annular traffic barrel bases adapted to provide ballast for traffic barrel barricades. Yet more preferably, the annular traffic barrel base 34 is made of rubber, recycled tires, or other suitable materials.

Figure 6:
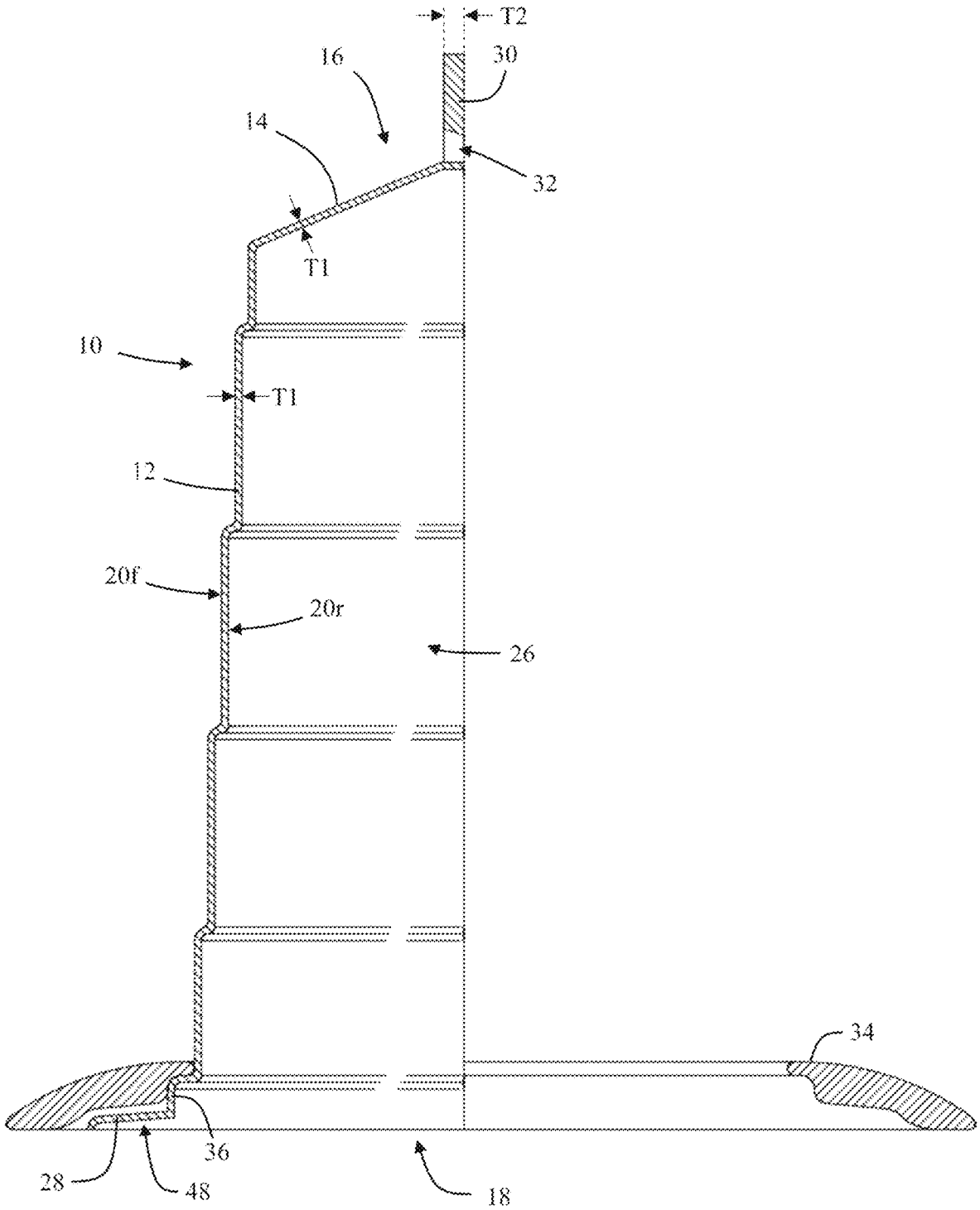
FIG. 6 is a section view of the traffic barricade and annular weighted base taken along the line 6-6 shown in FIG. 4.
Figure 7:
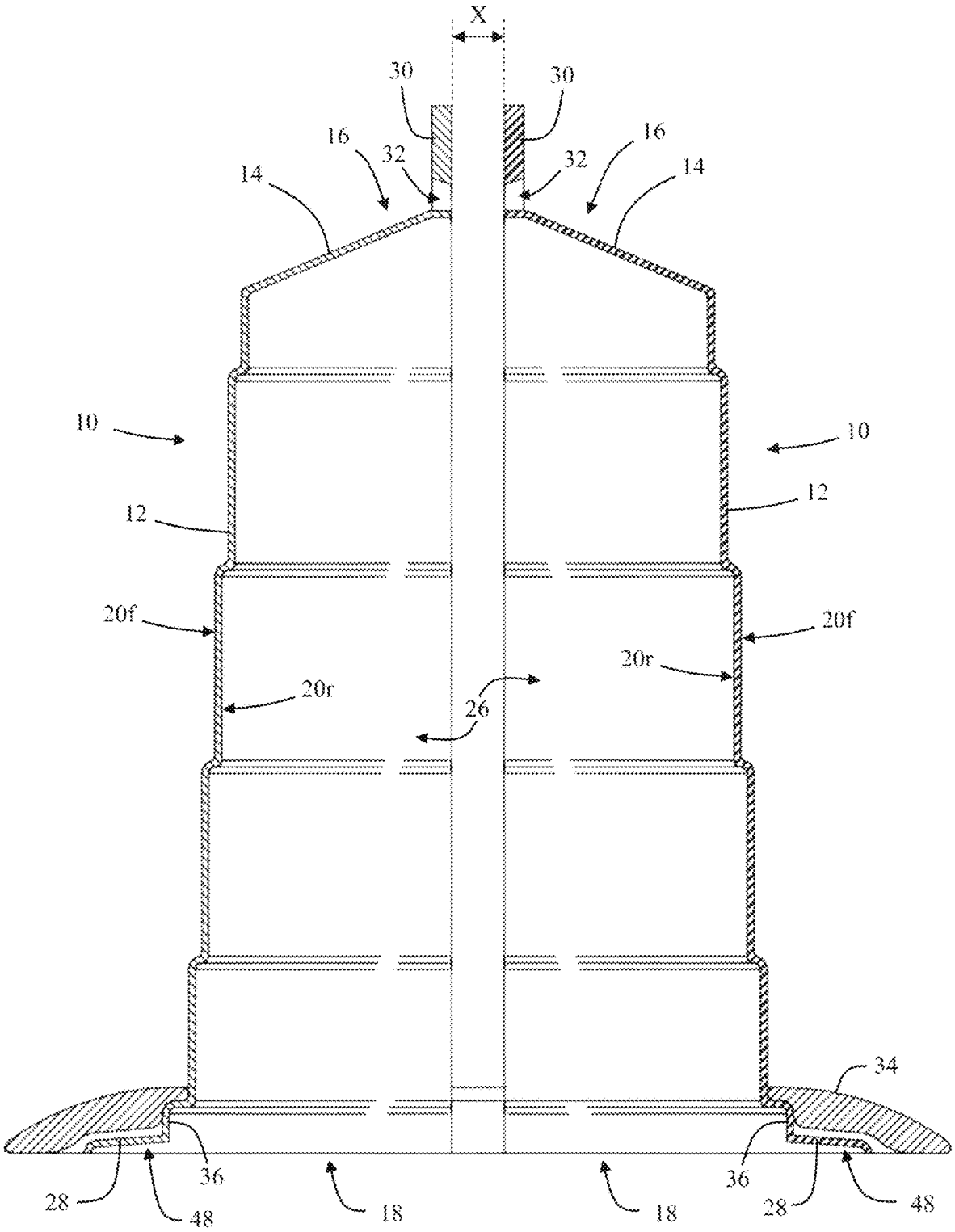
FIG. 7 is a section view similar to FIG. 6 but wherein a pair of traffic barricades are placed back-to-back and the annular weighted base is received over them.

As best seen in FIGS. 6 and 7, the bottom end 18 of the vertical wall 12 can further include a lip 36 adapted to engage the weighted base 34. Preferably, the lip 36 protrudes radially outboard from the front face 20*f* at the bottom end of half cylinder section 21*a*. The weighted base 34 can rest on both the bottom lip 36 and the foot extension 28 for preventing the traffic barricade 10 from sliding or tipping over from light collisions, wind, and/or air movement caused by passing vehicles.

In a first embodiment (FIGS. 4-6), each half barrel traffic barricade 10 is supported by its own base 34. In a second embodiment (FIG. 7), a pair of barricades 10 can be supported by a single base 34. In the second embodiment, the traffic barricades 10 are placed back-to-back such that an adjacent pair of barricades 10 are spaced a distance X apart from each other. Yet more preferably, the pair of barricades 10 are spaced approximately two inches apart from each other. However, it is also contemplated that the pair of barricades 10 can be formed such that they are against/abutting one another or spaced apart any distance as necessary or desirable.

Returning to FIGS. 1 and 2, the handle/mounting bracket 30 can include mounting bores 38 for securing lights or reflectors (not shown) to the traffic barricade 10. Additionally, the traffic barricade 10 can be manufactured with a high visibility color, such as, for example, safety orange, and the front and rear faces 20*f*, 20*r* can include reflective portions 40 adapted to reflect light from, for example, automotive headlights.

Preferably, the reflective portions 40 can be provided in an alternating, striped pattern corresponding to the stepped pattern of the vertical wall 12. For example, as shown in FIGS. 1 and 2, every other half cylinder section of the vertical wall can include a reflective portion 40 (e.g., on the half cylinder sections 21*b* and 21*d* on both the front face 20*f* and rear face 20*r*). Together, the high visibility color, reflective portions 40, and lights/reflectors (not shown) alert drivers to the locations of the traffic barricades 10 and further assist in directing and channeling traffic.

Figure 8:
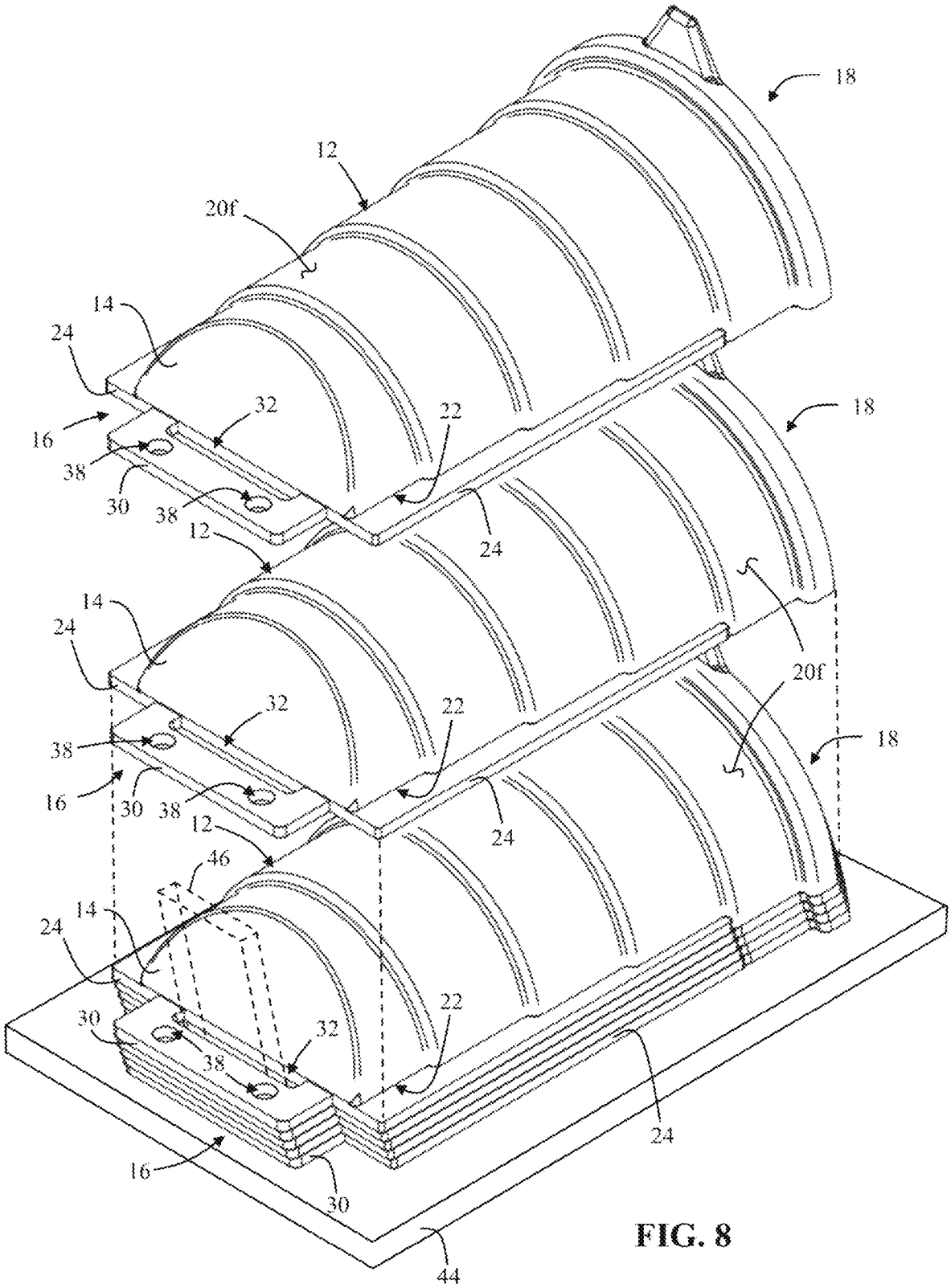
FIG. 8 is an exploded perspective view showing a plurality of nested/stacked traffic barricades.
Figure 9:
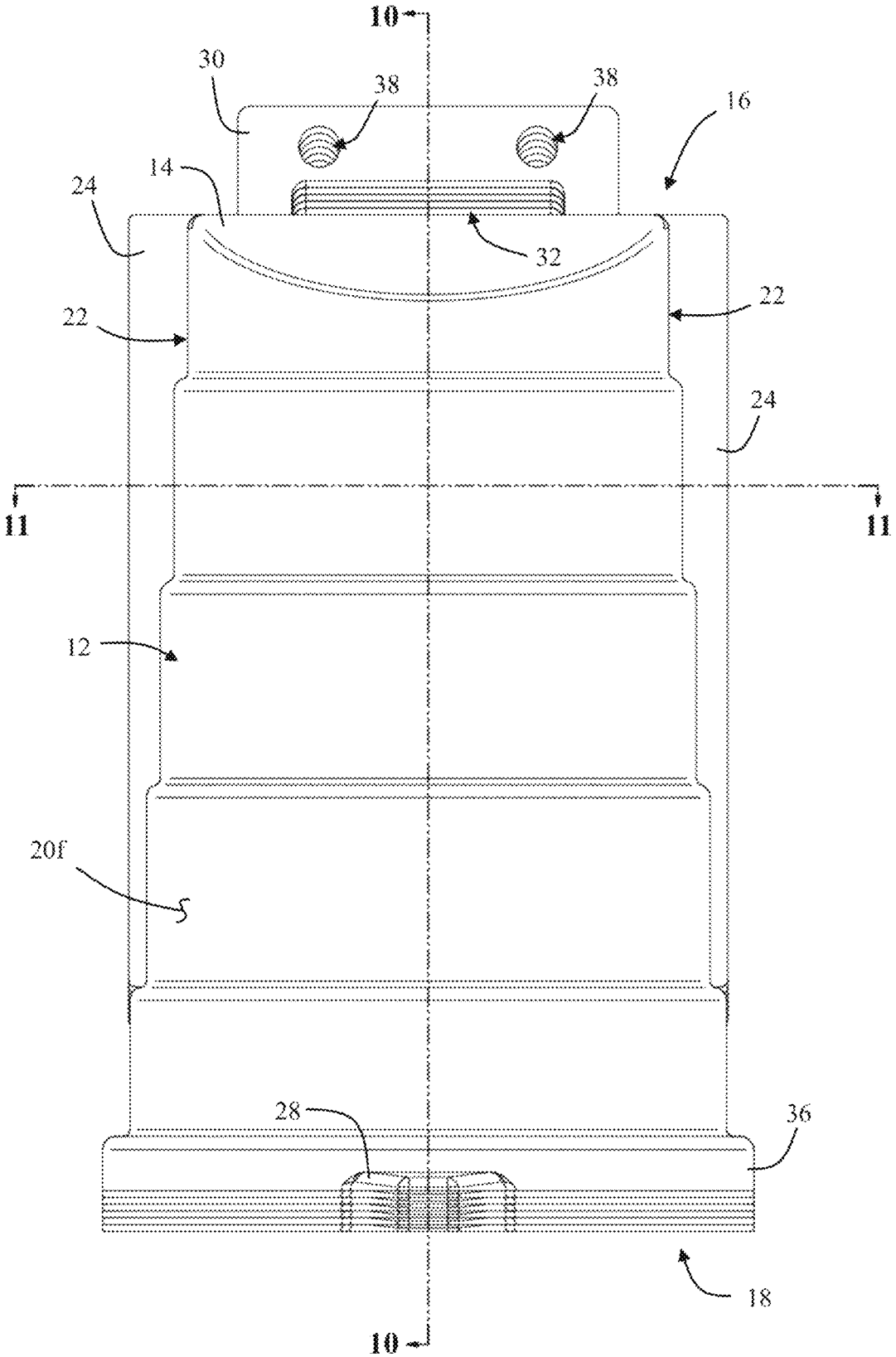
FIG. 9 is a top plan view of the nested/stacked traffic barricades shown in FIG. 8.
Figure 10:
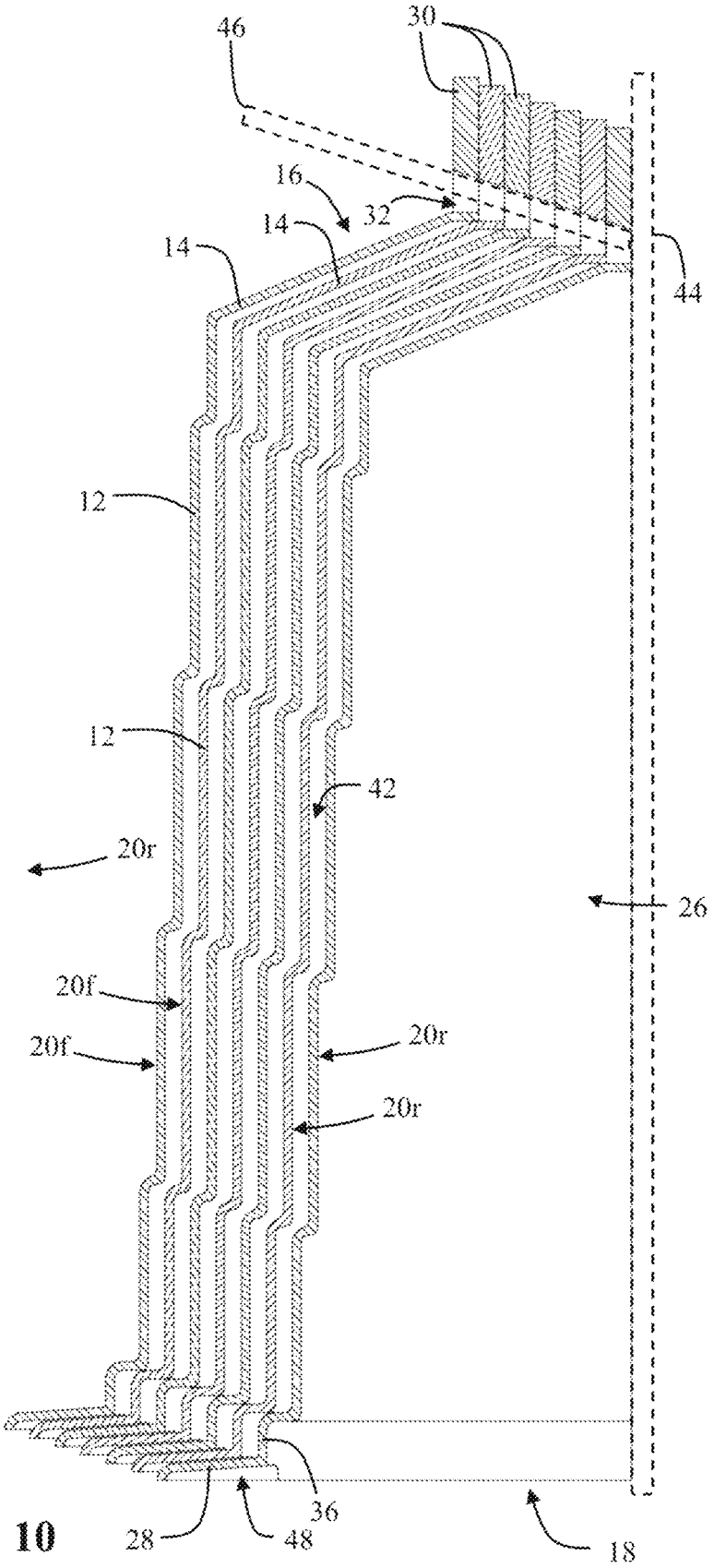
FIG. 10 is a section view of the nested/stacked traffic barricades taken along the line 10-shown in FIG. 9; and, FIG. 11 is a section view of the nested/stacked traffic barricades taken along the line 11-11 shown in FIG. 9.

When not in use, the traffic barricades 10 can be nested/stacked with each other for compact storage thereof. As best seen in FIGS. 8 and 10, the traffic barricades 10 are stackable by inserting the front face 20*f* thereof into the nesting/stacking pocket 26 of an adjacent barricade 10. The traffic barricades 10 are, preferably, nested/stacked in a horizontal manner with the front faces 20*f* thereof facing upward. The traffic barricades 10 can include stacking flanges 24 extending along the vertical wall edges 22. The stacking flanges 24 are adapted to be placed against/abutting the stacking flanges 24 of adjacent, nested/stacked barricades 10 for supporting the weight of successive barricades 10 stacked on top of each other. The stacking flanges 24 also provide transverse rigidity to the back/rear vertical edges 22 of the vertical half tube-shaped wall 12.

Figure 11:
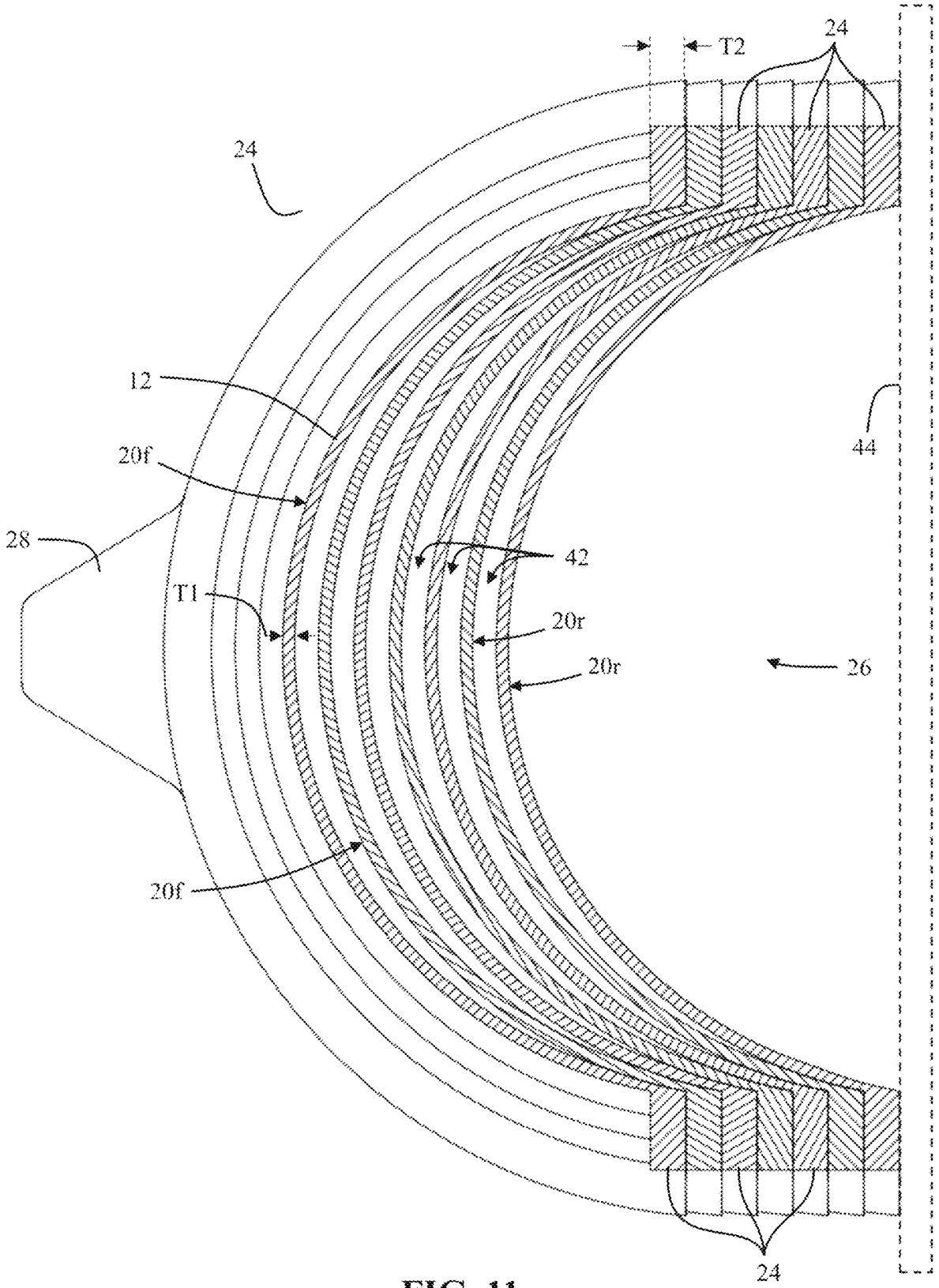

As shown in FIGS. 10 and 11, the vertical walls 12 and the top panels 14 have a thickness T1 and the stacking flanges 24 and the handle/mounting bracket 30 have a thickness T2. Preferably, the thickness T2 is greater than the thickness T1 such that, when successive barricades 10 are nested/stacked together, their respective stacking flanges 24 abut one another and a narrow gap 42 is formed between the vertical walls 12 of adjacent barricades 10. Accordingly, the weight of each successive nested/stacked barricade 10 is supported by the stacked, abutting stacking flanges 24, thereby preventing the weight of the traffic barricades 10 from deforming the vertical walls 12 during long term storage thereof.

As shown in FIGS. 8 and 10, a platform 44 having one or more storage securement and mounting members 46 can be provided for facilitating nesting/stacking of the traffic barricades 10. Preferably, the storage securement and mounting members 46 can be rectangular plate-shaped members, although it should be understood that the storage securement and mounting members 46 can have other shapes as needed or desired. Preferably, the handle slots 32 are sized and shaped to receive a storage securement and mounting member 46 therethrough. The traffic barricades 10 can be nested/stack on the platform 44 with the handle slots 32 thereof received over the member 46 for aligning the traffic barricades horizontally relative to each other and for preventing a stack of nested barricades from moving or toppling during transportation thereof.

As best seen in FIG. 10, each successive barricade 10 that is nested/stacked on top of an adjacent barricade 10 is slightly horizontally displaced by a distance equal to the thickness T1 of the top panel 14. Accordingly, the handle slots 32 can be slightly tapered for aligning with the handle slots 32 of adjacent nested/stacked barricades 10 and allowing the storage securement and mounting member 46 to extend through the handle slots 32 of each nested/stacked barricade 10. Of course, the member 46 extends at an angle relative to the platform and aligns with the slope of the handle slots 32.

The vertical wall 12, top panel 14, handle/mounting bracket 30, foot extension 28, and stacking flanges 24 are preferably integrally formed from a plastic material by, for example, blow molding, injection molding, vacuum forming, or otherwise molding or forming from a unitary material. Yet more preferably, the vertical wall 12, top panel 14, handle/mounting bracket 30, foot extension 28, and stacking flanges 24 are integrally formed from a light weight plastic material such as, for example, high or low density polyethylene.

Preferably, as best seen in FIG. 10, a foot pocket 48 is provided extending through the bottom end 18 and the rear face 20*r* and into the foot extension 28. The foot pocket 48 is adapted to receive the foot extension 28 of an adjacent barricade 10 such that the foot extensions 28 nest with each other when the traffic barricades are nested/stacked together.

While this invention has been described as having an exemplary design, the present invention may be further modified within the spirit and scope of this disclosure. This application is therefore intended to cover any variation, uses, or adaptations of the present invention using its general principles.

What is claimed is:

1. A half barrel traffic barricade for use with an annular traffic barricade base, the traffic barricade comprising:

a half tube-shaped vertical wall having a top end and a bottom end; and, a top panel provided at and closing the top end;

wherein the annular traffic barricade base is received over the vertical wall and engages the bottom end thereof for supporting the traffic barricade in a vertical position.

2. The half barrel traffic barricade of claim 1 wherein the vertical wall further comprises a convex front face, a concave rear face, and vertical wall edges.

3. The half barrel traffic barricade of claim 2 further comprising stacking flanges provided along the vertical wall edges.

4. The half barrel traffic barricade of claim 1 wherein the vertical wall is stepped.

5. The half barrel traffic barricade of claim 1 further comprising a foot extension provided at the bottom end, wherein the annular traffic barricade base engages the foot extension for supporting the traffic barricade in its vertical orientation.

6. The half barrel traffic barricade of claim 2 wherein the convex front face and the concave rear face further comprise one or more reflective portions.

7. The half barrel traffic barricade of claim 6 wherein the convex front face and the concave rear face further comprise two or more reflective portions, and wherein the reflective portions are arranged in an alternating, striped pattern.

8. The half barrel traffic barricade of claim 1 further comprising a handle provided at the top end of the vertical wall.

9. The half barrel traffic barricade of claim 1 further comprising a handle provided at the top end of the vertical wall, wherein the handle includes one or more mounting bores for mounting lights or reflectors thereon.

10. A traffic delineator device for directing and channeling traffic, the device comprising:

an annular traffic barricade base; and, a half barrel traffic barricade comprising:

a half tube-shaped vertical wall having a top end and a bottom end; and, a top panel provided at and closing the top end;

wherein the annular traffic barricade base is received over the vertical wall and engages the bottom end thereof for supporting the half barrel traffic barricade in a vertical position.

11. The traffic delineator device of claim 10 wherein the half barrel traffic barricade further comprises a handle provided at the top end of the vertical wall and a foot extension provided at the bottom end.

12. The traffic delineator device of claim 11 wherein the annular traffic barricade base is received over the vertical wall and engages the foot extension for supporting the half barrel traffic barricade in its vertical position.

13. The traffic delineator device of claim 11 wherein the handle includes one or more mounting bores for mounting one or more lights or reflectors to the half barrel traffic barricade.

14. The traffic delineator device of claim 10 wherein the vertical wall further comprises a convex front face and a concave rear face, and wherein the front and rear faces include reflective portions.

15. The traffic delineator device of claim 13 wherein the vertical wall further comprises a convex front face and a concave rear face, and wherein the front and rear faces include reflective portions.

16. A traffic directing/channeling system comprising:

a plurality of annular traffic barricade bases; and, a plurality of half barrel traffic barricades, each half barrel traffic barricade comprising:

a half tube-shaped vertical wall having a top end and a bottom end; and, a top panel provided at and closing the top end;

wherein an annular traffic barricade base is received over each vertical wall and engages the bottom end thereof for supporting the half barrel traffic barricades in a vertical position.

17. The traffic directing/channeling system of claim 16 wherein the vertical walls further comprise convex front faces, concave rear faces, and vertical wall edges, and wherein a nesting/stacking pocket is defined between the concave rear faces and the adjacent top panels.

18. The traffic direction/channeling system of claim 17 wherein the half barrel traffic barricades are nestable/stackable by inserting the front faces thereof into the nesting/stacking pocket of an adjacent half barrel traffic barricade.

19. The traffic directing/channeling system of claim 17 wherein the half barrel traffic barricades further comprise stacking flanges extending along the vertical wall edges.

20. The traffic directing/channeling system of claim 19 wherein the half barrel traffic barricades are nestable/stackable by inserting the front faces thereof into the nesting/stacking pocket of an adjacent half barrel traffic barricade, and wherein the stacking flanges of adjacent nested/stacked half barrel traffic barricades are placed against/abutting one another for supporting the weight of the nested/stacked half barrel traffic barricades.

* * * * *